United States Patent [19]

Gibbons

[11] Patent Number: 4,709,764

[45] Date of Patent: Dec. 1, 1987

[54] SHEET PILE SUPPORTED DRIVER

[75] Inventor: Frank B. Gibbons, Mesa, Ariz.

[73] Assignee: Maxine S. Gibbons, Pataskala, Ohio

[21] Appl. No.: 819,344

[22] Filed: Jan. 16, 1986

[51] Int. Cl.[4] ..... E21B 15/04

[52] U.S. Cl. ..... 173/45; 405/232

[58] Field of Search ..... 173/45, 22, 31, 19, 173/25, 157; 405/232

[56] References Cited

U.S. PATENT DOCUMENTS

| | | | |
|---|---|---|---|
| 1,954,523 | 4/1934 | Doyle | 405/232 |
| 3,279,195 | 10/1966 | Taylor | 405/232 |
| 3,657,896 | 4/1972 | Ishihara et al. | 405/232 |
| 3,866,425 | 2/1975 | Morrice | 405/232 |
| 3,927,861 | 12/1975 | Dumont | 405/232 |

*Primary Examiner*—E. R. Kazenske

*Assistant Examiner*—Willmon Fridie, Jr.

*Attorney, Agent, or Firm*—Fleit, Jacobson, Cohn & Price

[57] ABSTRACT

A sheet pile driver and more particularly a driver which is supported from a single wall of already driven sheet piles for stabbing and driving subsequent sheet piles progressively into final position and then moving progressively onto the newly driven sheet piles with the driver being supported solely from the single wall of sheet piles and movable in either direction thereon. This invention also relates to a method of constructing a continuous steel sheet pile wall by the use of sheet piles with a driver riding on partially installed sheet piles and capable of moving back and forth the entire length of the partially installed wall and being a self-stabbing unit, grade driving unit or extractor to enable the construction of a sheet pile wall with reduction in equipment required and an increase in production rates.

7 Claims, 6 Drawing Figures

4
4
12
14
16
20
36
38
40
42
44
48
50
52
54
56
58
60
62
64
66
75
78
80
82
84
86
88
90
92
94

SHEET PILE SUPPORTED DRIVER

BACKGROUND OF THE INVENTION

1. Field of the Invention

The present invention generally relates to a sheet pile driver and more particularly a driver which is supported from a single wall of already driven sheet piles for stabbing and driving subsequent sheet piles progressively into final position and then moving progressively onto the newly driven sheet piles with the driver being supported solely from the single wall of sheet piles and movable in either direction thereon. This invention also relates to a method of constructing a continuous steel sheet pile wall by the use of sheet piles with a driver riding on partially installed sheet piles and capable of moving back and forth the entire length of the partially installed wall and being a self-stabbing unit, grade driving unit or extractor to enable the construction of a sheet pile wall with reduction in equipment required and an increase in production rates.

2. Information Disclosure Statement

Sheet piles are driven into the ground surface to form a continuous wall, bulkhead or the like. Usually, a ground supported crane lifts the sheet piles and places them in position and starts the sheet piles, generally referred to as stabbing, with the edges of the sheet piles interlocked. Thereafter, the crane is used to progressively drive the sheet piles in stages with the penetration varying with the nature of the soil conditions. Driving the sheet piles in successive steps or stages requires repeated movement of the pile driver along the length of the wall. Such operations usually require two cranes with one crane stabbing the sheet piles and the second crane driving the sheet piles. A single crane may be used but this increases the travel time of the crane, thereby reducing production rates and considerable equipment is required in constructing a wall of sheet piles by using a mobile ground supported crane or cranes.

SUMMARY OF THE INVENTION

An object of the present invention is to provide a driver for sheet piles supported on a single wall of sheet piles for movement in both directions to enable placement or stabbing of sheet piles and the driving of sheet piles in progressive stages to a final position with the driver including unique mechanisms for supporting and stabilizing itself on the sheet piles and a relatively short boom structure for placement, stabbing and driving or extracting sheet piles.

Another object of the invention is to provide a sheet pile driver in accordance with the preceding object including adjustable components engaging the top edges of sheet piles and depending adjustable components engaging opposite surfaces of sheet piles to retain the driver in stable supported condition but yet enabling movement in both directions to facilitate the driving of sheet piles with a reduction in equipment and at a higher production rate.

A further object of the invention is to provide a sheet pile driver in accordance with the preceding objects in which the driver is supported from the top edge of the sheet piles thereby rendering the supporting and moving functions of the driver independent of ground conditions thus enabling the construction of a wall or bulkhead without regard to providing a stable support for a ground supported mobile crane or cranes thereby saving considerable time and expense which is frequently required to provide an appropriate supporting surface for a ground supported mobile crane.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
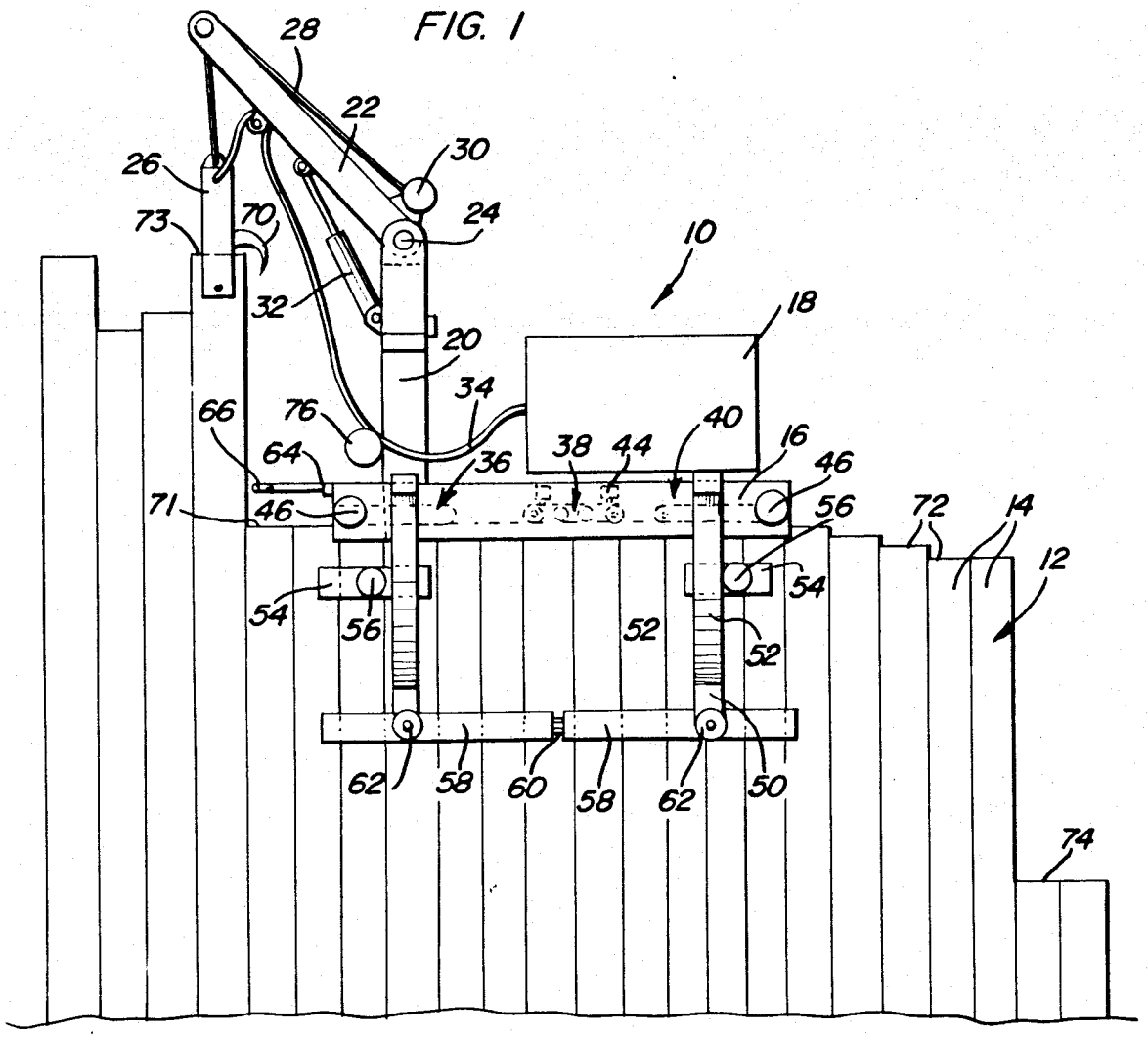
FIG. 1 is a side elevational view of the driver of the present invention illustrating the manner in which it is supported from the top edge of a single wall formed by a plurality of sheet piles.
Figures 3, 4, 5, 6:
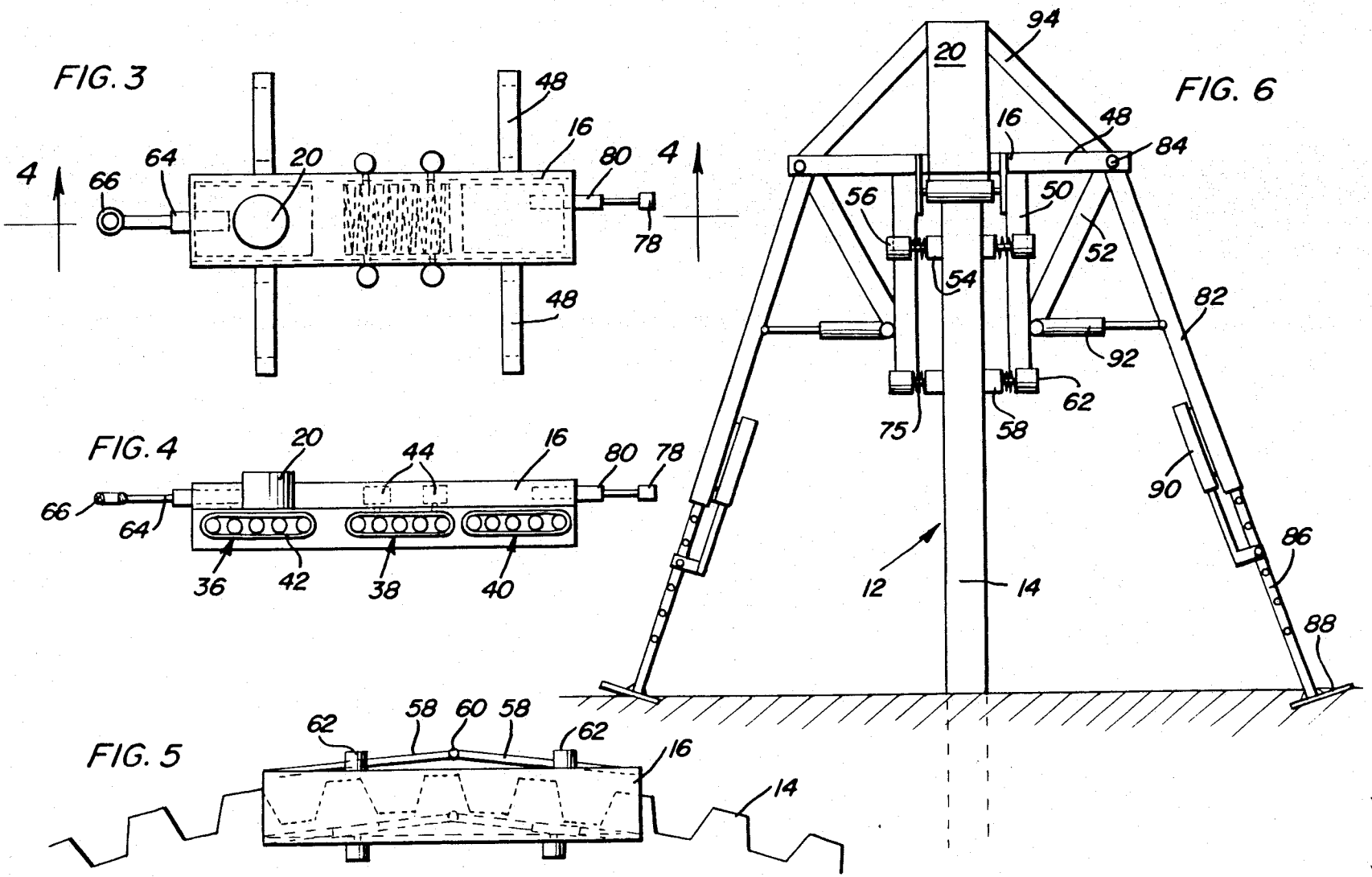
FIG. 3 is a plan view of the driver with certain components removed.
FIG. 4 is a side elevational view of the construction of FIG. 3.
FIG. 5 is a diagrammatic plan view illustrating the manner in which the driver may move on a curved wall formed by a plurality of sheet piles.
FIG. 6 is an end view similar to FIG. 2 but illustrating an embodiment of the invention utilziing adjustable braces.

Referring now specifically to the drawings, the driver of the present invention is generally designated by the numeral 10 and is supported on top of a wall 12 formed by a plurality of sheet piles 14 which are of Z-shaped configuration with the sheet piles being interconnected along the edges and coacting to form a continuous wall 12 having oppositely opening, vertically disposed channel-shaped configurations as illustrated in FIG. 5. As illustrated in FIG. 1, the sheet piles 14 are driven to final position in stages and the driver of the present invention is utilized to initially place and set or stab the sheet piles and drive them downwardly in successive stages to a final position such as that illustrated in the right-hand portion of FIG. 1 with the initial placement or stabbing being illustrated in the left-hand portion of FIG. 1 with the driver being capable of movement back and forth along the top edge of the wall 12 and driving the sheet piles 14 from the initial set position to a final position in successive stages with the driver being capable of lowering itself from one vertical elevation to another during longitudinal movement along the top edge of the wall 12 for driving the sheet piles in progressive stages.

As illustrated, the driver 10 includes a frame or platform 16 having a control cab or housing 18 mounted thereon which may receive an operator and operating machinery. The frame 16 and housing 18 are schematically illustrated since these components may take various forms and configurations. The frame 16 supports a boom pedestal 20 at one end thereof with a boom 22 being hingedly connected to the upper end thereof as at 24 with a hammer 26 being supported from the outer end of the boom 22 by a cable 28 and winch 30. The angular movement of the boom 22 may be varied by the piston and cylinder arrangement 32, all of which represents conventional structural components for varying the angular position of the boom 22 and varying the elevational position of the hammer 26 which is controlled by a control cable 34 which extends back to the housing 18 for manipulation by an operator. The boom 22 can swing about a vertical axis defined by the pedestal 20 and any suitable mechanism may be provided for controlling this movement so that the hammer 26 can be oriented forwardly or rearwardly of the frame 16 to any degree desired within the confines of the length of the boom 22 and the adjustment thereof.

Figure 2:
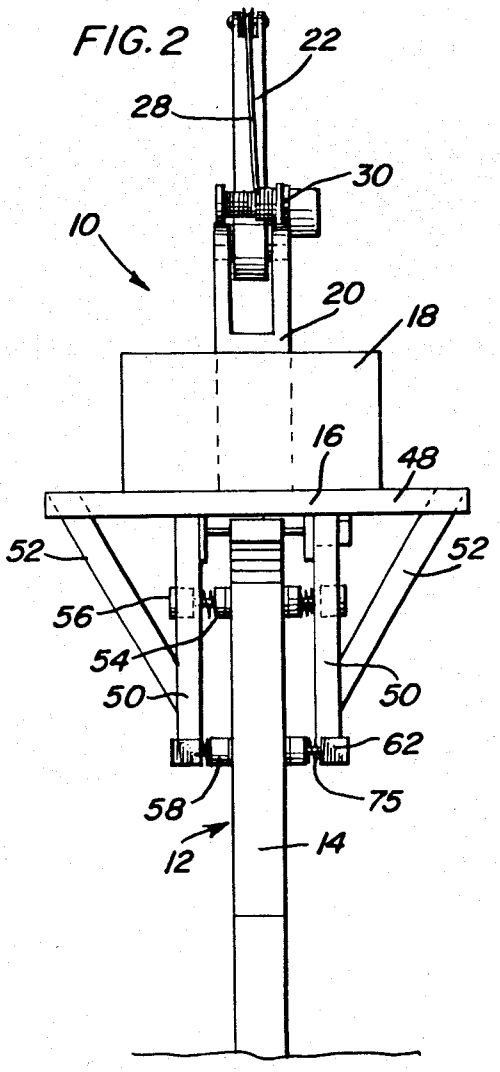
FIG. 2 is an end elevational view of the construction of FIG. 1.

Supported from the frame 16 is a plurality of roller assemblies 36, 38 and 40 each of which may include an encircling endless belt or tread 42 which engages the upper edge of the wall 12 formed by a plurality of sheet piles 14. Hydraulic cylinders 44 are provided for supporting the center roller assembly 38 from the frame 16 so that it may be adjusted vertically. The endmost roller assemblies 36 and 40 are provided with power motors such as hydraulic motors 46 which are reversible to enable the frame 16 to be moved longitudinally on the wall 12. The platform 16 includes four outwardly extending support members 48 in the form of outriggers which includes a depending support member 50 secured to the frame or platform 16 and braced by diagonal brace members 52. The depending support members 50 are generally perpendicular to the frame or platform and parallel to the wall 12 on opposite sides thereof with each of the support members 50 including a guide shoe 54 that is longitudinally elongated and disposed below the frame 16 as illustrated in FIGS. 1 and 2. Hydraulic piston and cylinder assemblies 56 support the guide shoes 54 adjustably from the vertical support members 50. Thus, with the depending support members 50 being rigid with the frame or platform 16, the hydraulic piston and cylinder assemblies 56 which react against the rigid support members 50 can provide a clamping action against the opposite surfaces of the wall 12 by the guide shoes 54 with this structure enabling a clamping action to be exerted on the sheet piles forming the wall for lateral adjustment of the frame 16 so that the frame 16 can be centered over the sheet piles with the roller assemblies properly oriented in relation thereto. In addition, each of the support members 50 includes an elongated guide shoe 58 at the lower end thereof with the guide shoes being elongated and having hingedly connected adjacent ends 60 as illustrated in FIG. 1. The hinge 60 enables the elongated guide shoes 58 to conform with the wall 12 especially in situations where the wall 12 is curved rather than being straight as illustrated in FIG. 5. As in conjunction with the guide shoes 54, the guide shoes 58 are also connected to the rigid support members 50 by hydraulic piston and cylinder assemblies 62. By manipulation of the hydraulic cylinders 56 and 62, the guide shoes 54 and 58 can clampingly engage the opposite sides of the wall 14 and can be operated to center the roller assemblies and frame 16 in relation to the wall 12 and orient the frame 16 in a level relation in order to stabilize and secure the driver in position on the wall but also enable the driver to move longitudinally in either direction along the top edge of the wall.

Projecting from one end of the frame 16 is a piston and cylinder assembly 64 having a ring 66 at the outer end thereof which can be associated with a hook 70 on the hammer 26 which unique structure enables the hook 70 to go into the ring 66 when the sheet pile 14 having the hammer 26 associated therewith reaches the working grade of the sheet piles 14 on which the driver rests as indicated by reference numeral 71 in FIG. 1 with the upper end of the sheet piles 14 engaged by the hammer being at the initial stab grade designated by numeral 73 in FIG. 1 and being driven downwardly to the working grade 71 at which point the hook 70 fixed to the hammer 26 will be engaged with the ring 66 so that by pulling or pushing with the hydraulic cylinder 64, the frame 16 can be moved to the left to the next sheet pile. The housing 18 includes a hydraulic power package, motor, pump, reservoir, control vavles or the like with the lines or conduits 34 extending from the control unit to the hammer 26 which is supported for vertical and lateral adjustment by the boom 22 on the crane formed by the pedestal and boom 22. As illustrated in FIG. 2, the piston and cylinder assemblies 56 and 62 may be provided with compression coil springs 75 in order to provide positive pressure on the shoes 54 and 56 in the event of failure of the hydraulic pressure system. At the base of the pedestal 20, an auxiliary winch 76 is provided which may be used to assist in moving the driver 10 and also to assist in alignment of the sheet piles 14. A sheet pile clamp 78 is mounted on the frame 16 opposite to the ring 16 with a hydraulic piston and cylinder assembly 80 interconnecting the frame 16 and the sheet clamp 78 which facilitates movement of the frame 16 in either direction and can be used to spread or squeeze the sheet piles 14. A comparable sheet pile clamp and hydraulic piston and cylinder assembly may be provided at each end of the frame 16 to provide alternate arrangements for moving the frame, spreading or squeezing the sheet pile. Also, the crane structure including the boom 22, winch 30 and cable 38 can be used to pull the frame 16 along the wall 12 by keeping the hammer 26 attached to the sheet pile and moving the boom 22 upwardly or downwardly with the angle of the cable from the head pulley to the hammer determining the vector of force exerted onto the frame 16 for moving the frame along the wall in this manner. Whenever the frame 16 is moved along the wall, the hydraulic piston and cylinder assemblies 56 and 62 can be controlled by operation of control valves to loosen these components from a tight clamping action to a clamping action which enables sliding movement of the guide shoes along the surfaces of the sheet piles 14 which form the wall 12.

FIG. 6 illustrates an optional arrangement in which additional stabilization is provided in the form of elongated legs 82 pivotally connected to the outer ends of the outrigger supports 48 by a pivotal connection 84. The lower end of each leg 82 is provided with a telescopic extensible section 86 terminating in a foot 88 engaging the ground surface with the ground engaging structure being a plate, roller and track assembly, float or the like to meet various ground conditions. A piston and cylinder assembly 90 interconnects the leg 82 and the telescopic section 86 to selectively extend and retract the foot 88. Also, a piston and cylinder assembly 92 interconnects the leg 82 and the lower end of brace 52 to vary the angular position of the leg 82 thus enabling the foot 88 to be oriented in optimum position for providing additional stability to the driver 10. Also, optional braces 94 may be provided between the outrigger support members 48 and the pedestal 20 or other components of the driver to further stabilize the driver with the braces 94 being optional and can be used with the stabilizing legs 82 or without them. Thus, when necessary, the optional legs 82 can be angularly adjusted and longitudinally adjusted by the piston and cylinder assemblies 90 and 92 to orient the foot in optimum relation to the ground surface to provide maximum stability to the driver with the retraction of the feet 88 enabling the driver to be moved longitudinally along the top edge of the wall after which the feet 88 are extended to stabilize the driver in a new position.

The roller and track assemblies are wider than the top edge of the sheet piles 14 and the center roller and track assembly 38 is vertically adjustable to raise or lower the frame during its movement along the top edge of the wall 12 so that the frame may move from the working grade along step grades 72 for climbing or descending with the driver being capable of driving the sheet piles 14 to final grade 74. The frame 16 has the ability to track on the curved sections of the wall as illustrated in FIG. 5 due to the roller and track assemblies being wider than the sheet piles and the side guides being adjustable with the hinge 60 in the lower guide shoes 58 enabling inward and outward adjustment and angulation so that the roller and track assemblies may follow the arc of curvature of the wall 12. Also, vibrations transmitted to the frame may be dampened with a tread or track on the roller assemblies of a resilient or elastic material for isolating as much of the frame as possible from the wall. The frame 16 will be prevented from rotation in the plane containing the wall by the guide shoes, the squeeze pressure of the springs 75 and the piston and cylinder assemblies for balancing the various weight components of the frame and driver about the center of gravity of the frame.

With this invention, there is provided a method of constructing a continuous steel sheet pile wall by use of sheet piles with one or more drivers riding on partially installed sheet piles and being able to move back and forth the entire length of the partially installed wall and forming a self-stabbing unit or grade driving unit or extractor. This device enables controlled driving or extraction of sheet piles which is not reliant on the ground conditions since the sheet piles can be set and driven or extracted even if poor ground support exists thereby eliminating the necessity and expense of providing adequate ground support which is necessary when using a conventional crane structure supported from the ground or other surface adjacent the sheet piles being driven. Various types of power can be used for the hammer such as hydraulic, pneumatic, explosive or diesel and drop or combinations thereof may be used. Also, the driver can be moved along the wall using various control arrangements such as powering the roller and track assemblies, the hook on the hammer engaging a ring having a hydraulic cylinder connecting it to the frame, pulling the frame with the boom and hammer line at an angle other than vertical, an auxiliary winch on the frame and the hydraulic cylinder and sheet clamp on each end of the frame to push or pull the frame which also enables the sheet piles to be pulled or pushed for alignment and assisting in holding adjacent sheets to prevent friction in the interlocks between adjacent sheet piles from dragging down adjacent sheet piles. Likewise, the forces exerted by the guide shoes provides for alignment of the wall or sheet piles to the left and right of the center line of the wall thereby providing an efficient method and apparatus for installing sheet piles to form a wall which can also be used to extract sheet piles if necessary by substituting an extractor arrangement for the hammer.

The specific details of the various components have not been illustrated in detail. However, the relationship of these components are illustrated along with the functional association thereof. Also, the specific details of the control apparatus and the power supply apparatus has not been disclosed since these components in and of themselves are also conventional. The association of the components to provide the desired functional results are set forth to provide a sheet pile driver that is supported directly from the sheet pile wall and the various components are selected and assembled using well accepted engineering techniques.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A driver for sheet piles adapted to be supported from the upper edge of a wall formed by a plurality of sheet piles comprising a frame, boom means on the frame, a sheet pile hammer supported from said boom means, a plurality of longitudinally extending and longitudinally spaced roller and track assemblies on the frame and adapted to be in supporting engagement with the top edge of a sheet pile wall to enable the frame to move in both directions along the top edge of the sheet pile wall, and means on the frame and depending therefrom in laterally spaced relation for engaging opposite surfaces of the sheet pile wall below the top edge thereof for stabilizing the frame on the top edge of the sheet pile wall, said means on the frame and depending therefrom including a pair of laterally spaced depending support members rigid with the frame, each of said support members including a pair of vertically spaced guide shoes thereon for engaging the surface of a sheet pile wall, and means interconnecting the support members and guide shoes for providing clamping force on the guide shoes for biasing the guide shoes into clamping engagement with the opposite surfaces of the sheet pile wall, said means interconnecting the depending support members and guide shoes including a hydraulic piston and cylinder assembly and a spring device associated with each guide shoe and extending from a support member for exerting clamping pressure on the guide shoes with the clamping pressure being variable by operating the piston and cylinder assembly and being maintained in the event of hydraulic pressure failure by the spring means, the lowermost guide shoes on each of the depending support members being horizontally elongated and disposed in horizontal alignment and generally perpendicular to the support members with the inner ends being disposed in adjacent relation and means hingedly interconnecting the adjacent ends of the horizontally elongated shoes to enable movement of the guide shoes and frame along the top edge of a curved sheet pile wall, each of said roller and track assemblies having a width substantially greater than the width of the sheet pile wall with manipulation of the guide shoes enabling the roller and track assemblies and frame to be centered and laterally adjusted in relation to the wall, said frame having three roller and track assemblies thereon with the centermost roller and track assembly being vertically adjustably connected to the frame for vertical movement to enable the frame to move along uneven upper edge portions of the sheet pile wall, means reversibly driving the endmost roller and track assemblies for moving the driver along the top edge of the wall, at least one end of the frame being provided with a sheet pile clamp connected to a piston and cylinder assembly extending longitudinally therefrom and connected to the frame to enable the frame to be pushed or pulled along the top edge of the wall.

2. The driver as defined in claim 1 wherein the hammer includes a rigid hook thereon, said frame including a longitudinally extending ring and piston and cylinder assembly oriented in predetermined relation to a working grade of the upper edge of the sheet pile wall for engagement by the hook when the hammer drives the sheet pile to which it is connected to the working grade for connecting the hammer with the ring thereby enabling the ring to be pushed or pulled by extending or retracting the piston and cylinder assembly when the hammer is connected with the sheet pile wall.

3. The driver as defined in claim 2 wherein said boom means supports the hammer by a flexible cable with angulation of the flexible cable enabling the frame to be moved along the wall by manipulating the boom and suspending cable to provide a longitudinal vector of force to the frame.

4. The driver as defined in claim 2 together with leg brace members connected to the frame at each side edge thereof, each leg brace including a longitudinally extendible section to enable variation in the length thereof and including a foot at the lower end thereof for engageing a supporting surface, and means interconnecting the leg brace and depending support members to vary the angular position of the leg braces to further stabilize the frame on the upper edge of the sheet pile wall.

5. A driver for sheet piles adapted to be supported from the upper edge of a wall formed by a plurality of sheet piles comprising a frame, boom means on the frame, a sheet pile hammer supported from said boom means, a plurality of longitudinally extending and longitudinally spaced roller and track assemblies on the frame and adapted to be in supporting engagement with the top edge of a sheet pile wall to enable the frame to move in both directions along the top edge of the sheet pile wall, at least one end of the frame being provided with a sheet pile clamp connected to a piston and cylinder assembly extending longitudinally therefrom and connected to the frame to enable the frame to be pushed or pulled along the top edge of the wall.

6. The driver as defined in claim 5 wherein said means on the frame and depending therefrom includes a pair of laterally spaced depending support members rigid with the frame, each of said support members including a pair of vertically spaced guide shoes thereon for engaging the surface of a sheet pile wall, and means interconnecting the support members and guide shoes for providing clamping force on the guide shoes for biasing the guide shoes into clamping engagement with the opposite surfaces of the sheet pile wall.

7. The driver as defined in claim 6 wherein said means interconnecting the depending support members and guide shoes includes a hydraulic piston and cylinder assembly and a spring device associated with each guide shoe and extending from a support member for exerting clamping pressure on the guide shoes with the clamping pressure being variable by operating the piston and cylinder assembly and being maintained in the event of hydraulic pressure failure by the spring means, the lowermost guide shoes on each of the depending support members being horizontally elongated and disposed in horizontal alignment and generally perpendicular to the support members with the inner ends being disposed in adjacent relation and means hingedly interconnecting the adjacent ends of the horizontally elongated shoes to enable movement of the guide shoes and frame along the top edge of a curved sheet pile wall.

* * * * *